United States Patent [19]

Keller, Jr. et al.

[11] 4,133,168

[45] Jan. 9, 1979

[54] APPARATUS FOR REMOVING YARN WRAPS FROM SPINDLES

[75] Inventors: Alex J. Keller, Jr.; Eddie R. Best, both of Gastonia, N.C.

[73] Assignee: Automatic Material Handling, Inc., Bessemer City, N.C.

[21] Appl. No.: 879,904

[22] Filed: Feb. 21, 1978

[51] Int. Cl.[2] ..... D01H 11/00

[52] U.S. Cl. ..... 57/304; 57/305; 57/306

[58] Field of Search ..... 57/34 R, 34.5, 56, 34 TT; 28/292–295

[56] References Cited

U.S. PATENT DOCUMENTS

| | | | |
|---|---|---|---|
| 3,263,407 | 8/1966 | Jones, Sr. | 57/56 X |
| 3,312,051 | 4/1967 | Schumann et al. | 57/34.5 |
| 3,426,518 | 2/1969 | Winter et al. | 57/56 X |
| 3,579,761 | 5/1971 | Plonsker et al. | 57/34 R X |
| 3,782,094 | 1/1974 | Flowers et al. | 57/34.5 |

*Primary Examiner*—John Petrakes

*Attorney, Agent, or Firm*—Richards, Shefte & Pinckney

[57] ABSTRACT

Apparatus for removing underwound yarn wraps from the spindle of a spinning frame, including a carrier member mounted for driven movement along the spinning frame, and a pair of rotating brushes which are independently driven and independently arranged for movement toward and away from the spindles. A non-rotatable brush may also be associated with the carrier member, behind the rotatable brushes, to remove any wraps not removed by the rotatable brushes. A suction source is provided for collecting removed yarn wraps. The carrier member includes floor engaging wheels, and means for engaging rails extending along the spinning frame, and the carrier member permits vertical adjustment of the rail engaging means to facilitate mounting the carrier member on the rails. The apparatus is designed so as not to interfere with the movement of the traverse ring of the spinning frame, or with the fixed structure of the spinning frame during operation of the apparatus or during mounting of the apparatus on the rails. A cut-off switch is provided to engage the end of the spinning frame at the completion of the movement of the apparatus therealong and to stop further movement of the apparatus.

17 Claims, 7 Drawing Figures

Fig. 6
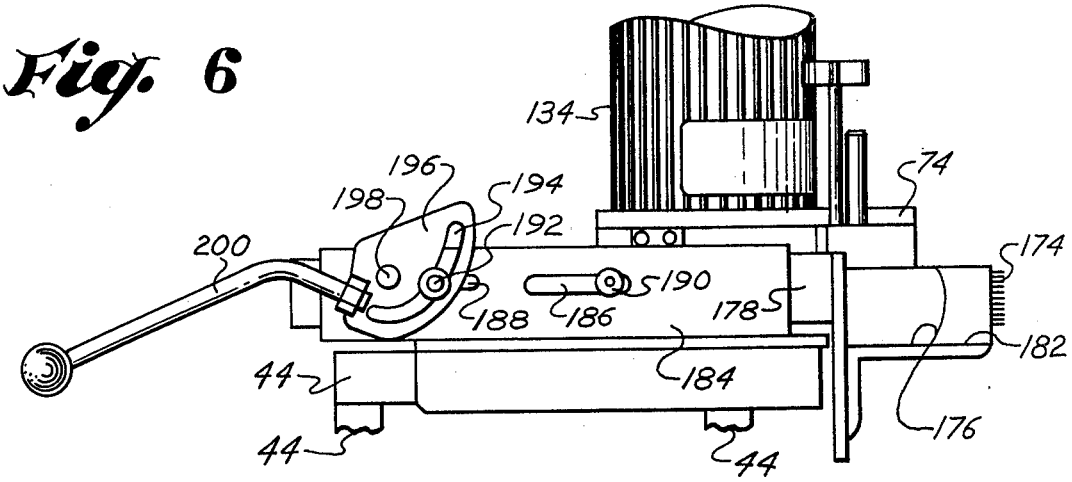
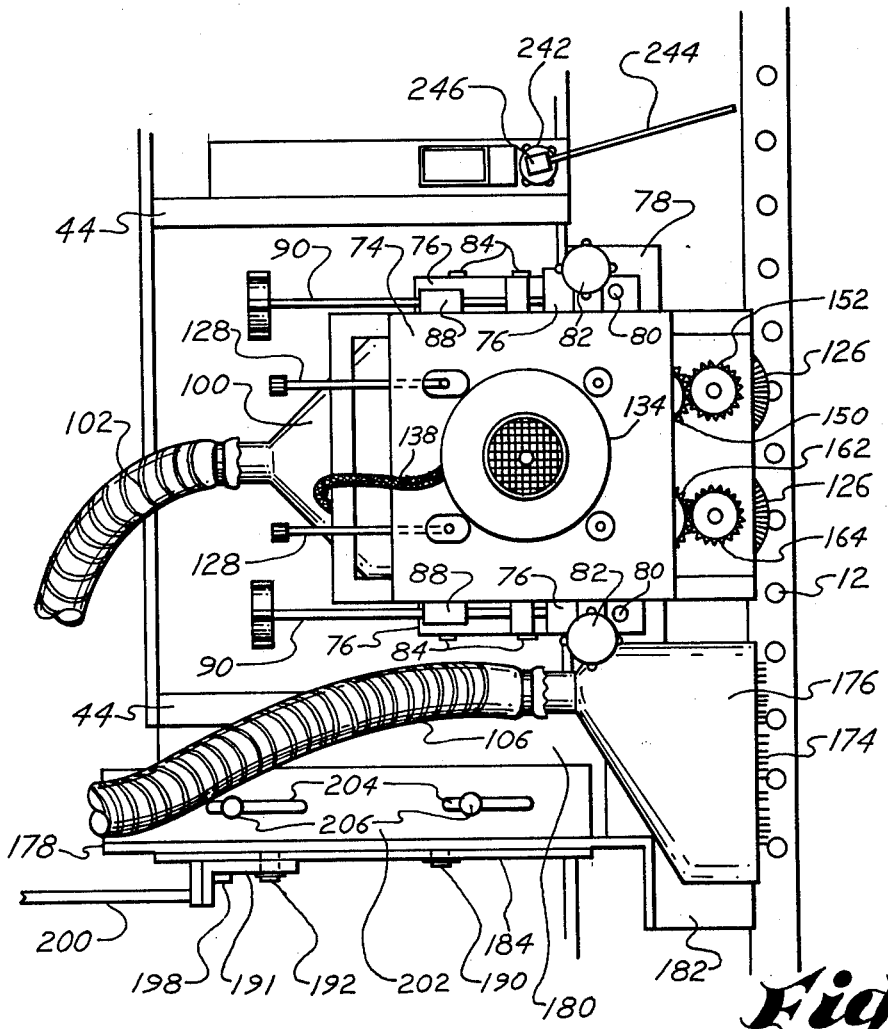
Fig. 7

APPARATUS FOR REMOVING YARN WRAPS FROM SPINDLES

BACKGROUND OF THE INVENTION

As is well known in the spinning art, it is common practice for the traverse ring of a spinning frame to apply several wraps of yarn about the base portion of the spindle upon which a package of yarn is being built, and these underwound wraps are allowed to remain on the lower portion of the spindle after the yarn package is doffed. After a period of time, these underwound yarn wraps will accumulate to an extent that they will interfere with the proper operation of the spinning frame, and it is therefore necessary to periodically clean the lower portion of the spindles by removing the accumulated yarn wraps thereon.

The most common method of removing the aforesaid yarn wraps is a manual operation which entails cutting the yarn wraps and physically pulling them off of the spindle. It will be apparent that this method is both time consuming and expensive, particularly since it usually results in a substantial down time for the spinning frame while the large number of spindles thereof are serially cleaned.

Additionally, several prior art patents disclose mechanical devices which are designed to assist in the removal of such yarn wraps. For wraps U.S. Pat. No. 3,263,407, issued Aug. 2, 1966, and U.S. Pat. No. 3,426,518, issued Feb. 11, 1969, both disclose frame members having fixed, projecting brush bristles attached thereto, such frame members being manually moved along a rail to permit the brush bristles to contact the lower portion of spinning frame spindles. In U.S. Pat. No. 3,312,051, a yarn removal device is disclosed which is generally similar to the two aforesaid prior art devices and which additionally includes a suction nozzle located adjacent the yarn removing element whereby removed yarn warps are carried away by the suction nozzle. Although the brushes in the aforesaid prior art devices may be mounted to have some relative movement with respect to the frames in which they are mounted whereby they can be urged against the spindles, they are otherwise fixed to the frame and must rely solely upon the rotation of the spindles, against which they are pressed, for removing the yarn wraps. Additionally, all of these prior art devices suffer the disadvantage of having to be manually moved along the rail of the spinning frame. It is believed that this manual movement is generally necessary to obtain full cleaning of the spindles by these devices because the generally fixed brushes may not remove all of the yarn wraps, particularly tightly wound wraps, in one pass of the brushes across the spindles, and the operator may manually cause the brushes to dwell longer at particular spindles, or to be passed several times across some of the same spindles.

In accordance with the present invention, spindle cleaning apparatus is provided which includes a plurality of individually mounted positively rotated brushes that are arranged to positively engage the spindles, and the apparatus may be driven along the spinning frame to remove automatically substantially all of the underwound wraps on such spindles.

SUMMARY OF THE INVENTION

The present invention includes a carrier member arranged for movement along a row of spindles on a spinning frame, and a plurality of rotating yarn stripping members which are positively driven in rotation and which are independently mounted for movement relative to the carrier member in a direction toward and away from such spindles whereby each yarn stripping member can independently engage the individual spindles, even where such spindles are misaligned with respect to one another. Preferably, the yarn stripping members are disc shaped brushes having an axis of rotation extending generally perpendicular to the direction of movement of the carrier member along the row of spindles.

In addition to being mounted for independent movement relative to the carrier member, the rotating brushes are independently driven from a common drive source which will accommodate such relative movement without adversely affecting the positive drive of any of the brushes. Such independent brush drives are specially designed so that they will not interfere with the normal upward and downward movement of the traverse ring of the spinning frame while the spindle cleaner is in place on the spinning frame.

A non-rotatable brush may also be mounted on the carrier means behind the rotating brushes to remove any wraps not removed by the rotating brushes such non-rotatable brush being mounted for selective movement between an active position at which the bristles will engage the spindles and an inactive position spaced from said spindles to permit mounting of the spindle cleaner on the spinning frame.

The spindle cleaner of the present invention preferably includes a suction source for removing yarn separated from the spindles by the rotating and non-rotating brushes, and the carrier member includes its own drive for automatically moving the entire spindle cleaning along the row of spindles of the spinning frame, a control switch being provided to deenergize this drive when the spindle cleaning apparatus reaches the end of a row of spindles.

The carrier member includes a two-part frame, one part having floor engaging which attached thereto for permitting the cleaning apparatus to be readily moved from one spinning frame to another and another part supporting the cleaning brushes and having means for mounting the apparatus on rails for movement along the spinning frame, these two parts being relatively adjustable with respect to one another in a vertical direction whereby the frame can be mounted on, and removed from, the aforesaid rails with very little effort.

BRIEF DESCRIPTION OF THE DRAWINGS

FIG. 6 is a partial side elevational view illustrating the non-rotatable brush and the slideable mounting therefor; and FIG. 7 is a plan view of the spindle cleaning apparatus of the present invention.

DESCRIPTION OF THE PREFERRED EMBODIMENT

Figure 1:
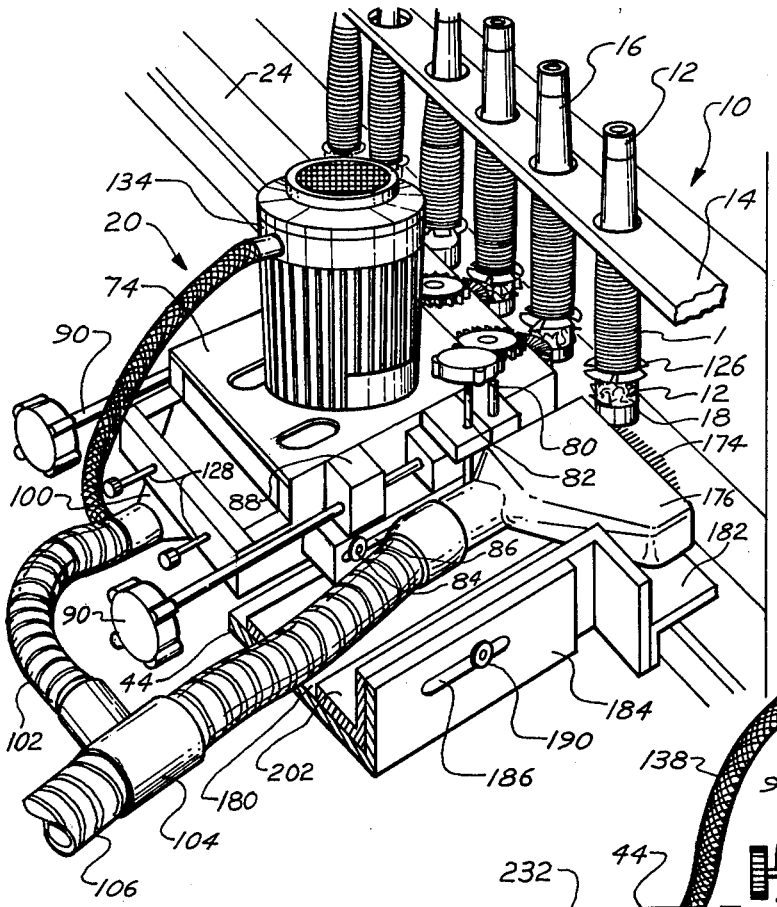
FIG. 1 is a general perspective view illustrating the carrier for the spindle cleaning apparatus of the present invention mounted for operation on a typical spinning frame.

Looking now in greater detail at the accompanying drawings, FIG. 1 illustrates a typical and conventional spinning frame 10 having a longitudinally extending row of rotating spindles 12 and traverse ring 14 which moves up and down along the vertical axes of the spindle 12 to carry yarn and build a yarn package on bobbins 16 removable carried on the spindles 12. After the yarn package has been built on the bobbin 16 and prior to doffing of the bobbins 16, the traverse ring 14 is caused to be lowered to a position beneath the bottom of the bobbins 16 whereby several wraps of yarn 18 are wound about the bottom portion of the spindles 12 to aid in bobbin doffing, bobbin replacement, and start-up procedures for the next set of bobbins. All of the foregoing is conventional and well-known, and the apparatus of the present invention is designed to remove accumulated yarn wraps 18 from the bottom of the spindles 12.

The spindle cleaning apparatus 20 of the present invention is designed for movement along a floor rail 22, and a fixed elevated rail 24 that is preferably secured directly to the spinning frame 10 along the longitudinal extent thereof whereby the bottoms of the spindle 12 will be cleaned, all in a manner to be described in greater detail below.

Figure 2:
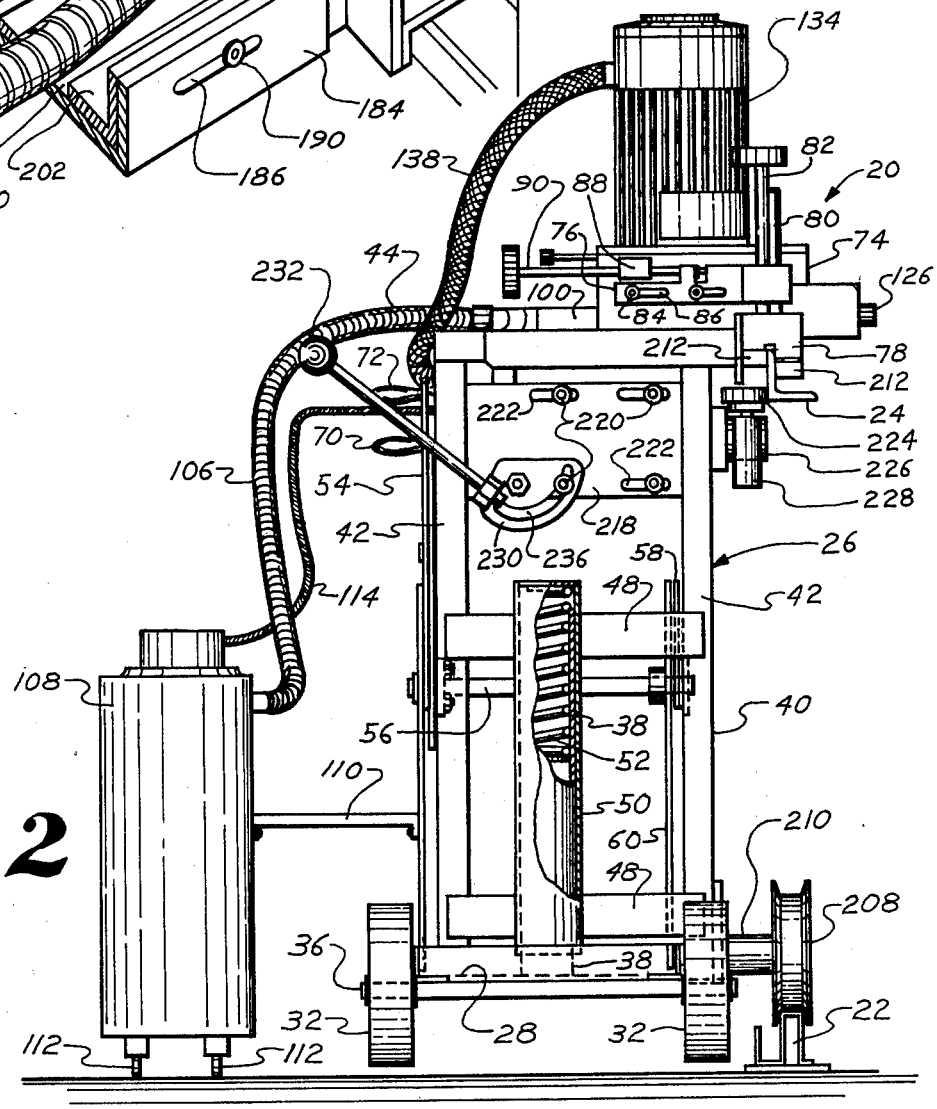
FIG. 2 is a side elevational view of the spindle cleaning apparatus of the present invention with the non-rotatable brush and mounting therefor removed to better illustrate details of the rotating brushing and mounting arrangement therefor.
Figure 3:
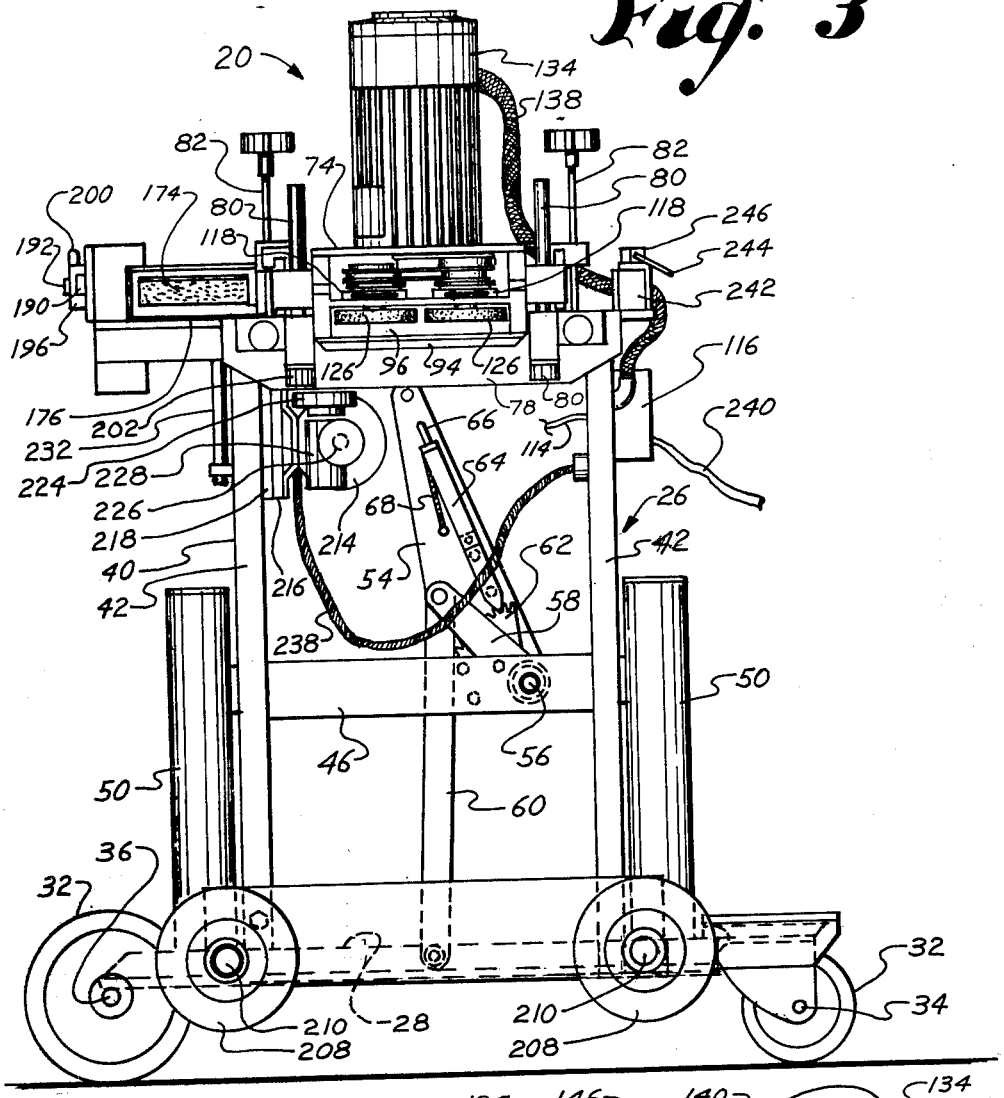
FIG. 3 is a front elevational view of the spindle cleaning apparatus of the present invention.

As best seen in FIGS. 2 and 3, the spindle cleaner 20 includes a frame 26 comprising a lower portion 28 formed with a generally rectangular base having four floor engaging wheels 32 carried thereon by axles 34 and 36, respectively, each end of the base having fixed thereto a vertically extending tubular member 38. The frame 26 also includes an upper portion 40 having four vertical stanchions 42 connected together at the tops thereof by horizontally extending supports 44 and connected together at intermediate vertical positions by two pairs of cross-braces 46, located at the front and back, respectively, of the upper frame portion 40 and by two further pairs of cross-braces 48 located at each side of the upper frame portion 40. Each pair of side cross-braces 48 have fixed thereto vertically extending tubular receiver members 50 which, as best seen in FIG. 2, telescopically and slidably receive the aforesaid tubular members 38 fixed the lower frame portion 28, and a coil spring 52 is contained within the tubular members 38 to bear against the base 30 and the top wall of the receiver tubular members 50 to thereby urge the tubular members 50 and the upper frame portion 40 fixed thereto in an upward vertical direction relative to the lower frame portion 28. The slidably arranged tubular elements 38 and 50 constitute the sole connection between the upper frame portion 40 and the lower frame portion 28.

To lower the upper frame portion 40 with respect to the lower frame portion 28, an operating handle 54 is fixed to one end of pivot shaft 56 extending between corresponding front and back cross-braces 46, the other end of the pivot shaft 56 having a first link 58 fixed thereto and extending to a pivotal connection with a second link 60 that is, in turn, pivotably connected at its other end to the base of the lower frame portion 28.

In FIGS. 2 and 3, the upper frame portion 40 is shown at its lowest position with respect to lower frame portion 28, and the upper frame portion 40 is held at this position, against the urging of springs 52, by a fixed gear quadrant 62 having peripheral teeth that are engaged by holding element 64 slidably mounted in a slot 66 in the operating handle 54 and normally urged in a direction toward the gear quadrant 62 by a spring element 68. The holding element 64 has a grasping portion 70 projecting through the slot 66 adjacent to the knob 72 of the operating handle 54 whereby both can be simultaneously held in one hand.

When it is desired to raise the upper frame portion 40 with respect to the lower frame portion 28, for a purpose to be described presently, an operator grasps the portion 70 and moves the holding element 64 away from its engagement at the gear quadrant 62 whereupon the coil springs 52 will act against the top of tubular elements 50 to raise the upper frame portion 40, whereupon the operating handle 54 is caused by links 58 and 50 to pivot in a counter-clockwise direction (FIG. 3) until the upper frame portion 40 reaches its highest vertical position at which the holding element 64 is allowed to engage the gear quadrant 62. The springs 52 are preferably designed to have a lifting force substantially equal to the entire weight of the upper frame portion 40 and the apparatus fixed thereto so that such weight is effectively counter-balanced by the force of the springs 52, but it will be understood that the springs 52 could, if desired, be selected to overcome only a portion of such weight with the operator supplying the additional required force by pivoting the operating handle 54 in the aforesaid counter-clockwise direction. In either event, it will be appreciated that the springs 52 carry all or substantially all of the burden of raising the relatively heavy upper frame portion 40 and attachments thereto so that little or no strength is required by the operator.

When it is desired to lower the upper frame portion 40 with respect to the lower frame portion 28, the operator again releases the holding element 64 and pivots the operating handle in a clockwise direction (FIG. 3) to cause the tubular elements 50 to move downwardly and compress the springs 52, it being noted that since the weight of the upper frame portion 40 is effectively counter-balanced by the springs 52, little or no strength is required to lower the upper frame portion 40.

A rotatable brush housing 74 is carried at the top of the upper frame portion 40, such housing 74 being generally rectangular in shape and being slidably connected to a pair of side supports 76 located at each side thereof above the top support members 44 of the upper frame portion 40. A subframe member 78 is fixed to the front face of the upper frame portion 40, and includes a pair of fixed upstanding rods 80 that extend through openings in the housing side supports 76 whereby the housing 74 is vertically movable with respect to the upper frame portion 40. Additionally, a pair of upstanding screw elements 82 are threadably received in the side supports 76, respectively, with the lowermost ends thereof bearing against top support members 44 of the upper frame portion 40. Thus, the vertical position of the housing 74 may be varied with respect to the upper frame portion 40 by turning the screw elements 82 whereupon the housing 74 will move upwardly or downwardly on the vertical rods 80.

As indicated above, the housing 74 is slidably mounted in the side supports 76 by a pair of bolts 84 which are fixed to the housing 74 and extend through slots 86 in the side supports 76. Additionally, a shoulder element 88 is fixed to each side of the housing 74, and screw elements 90 are threadably received in the shoulder elements 88 with the ends thereof bearing against a vertical face of the side supports 76. Thus, when the screw elements 90 are turned, the housing 74 will move with respect to the frame 26 in a horizontal direction toward and away from the spindles 12.

Figure 4:
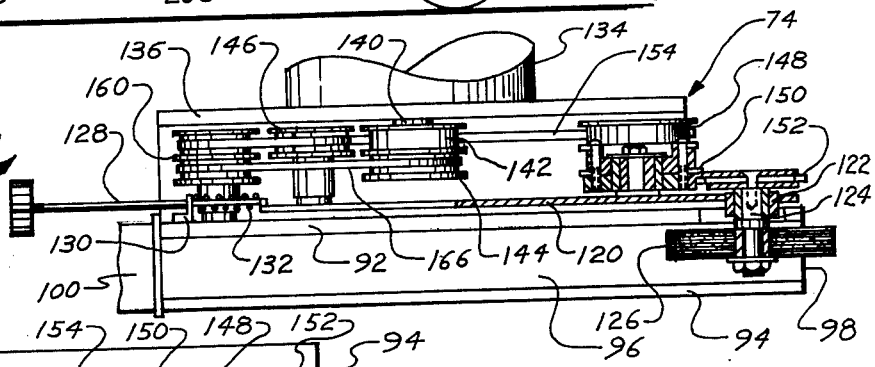
FIG. 4 is a detail sectional view taken in a vertical plane and illustrating the spindle cleaning brushes and suction conduit associated therewith.
Figure 5:
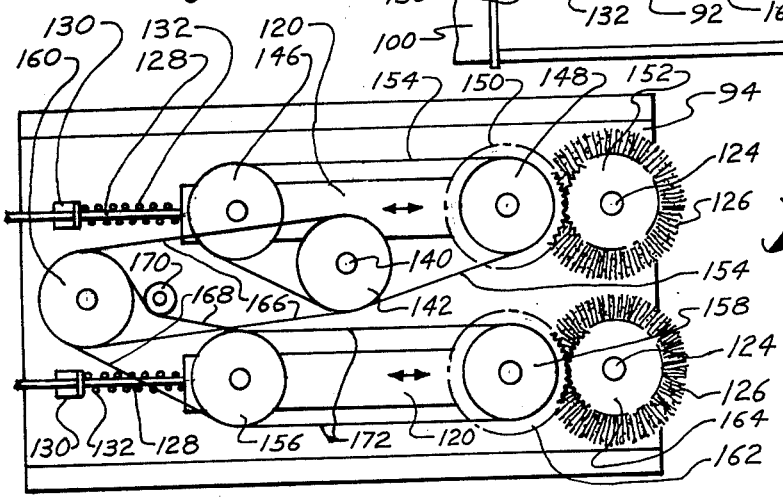
FIG. 5 is a plan view of the spindle cleaning rotatable brushes and drive therefor.

As best seen in FIGS. 4 and 5, the brush housing 74 includes a pair of spaced walls 92 and 94 defining a channel 96 therebetween having an air intake opening 98 at one end thereof and being connected to a suction header 100 at the other end thereof, the suction header 100 being connected to a length of tubing 102 that leads to a T-fitting 104 in a primary tubing length 106 that extends to a vacuum source 108 (see FIG. 2) The vacuum source 108 is connected in any convenient manner to the frame 26, such as by a detachable connecting element 110 and it is provided with wheels 112 which permit it to roll along the floor with the spindle cleaner 20. An electrical line 114 leads from an electrical junction box 111 of the spindle cleaner 20 to the vacuum source motor to provide a source of electricity thereto.

On top of the aforesaid wall 92 are mounted two pairs of fixed supports 118 (see FIG. 3), each pair supporting therebetween a sliding plate 120. One end of each plate 120 carries a bearing 122 for rotatably supporting a vertical shaft 124 having fixed at the lower end thereof a rotating disc-shaped brush 126 disposed in the suction channel 96 with a portion of the brush bristles projecting beyond the air intake opening 98 as best seen in FIG. 4 and with the rotating brushes 126 being rotatable about a vertical axis perpendicular to the direction of movement of the frame 26 along the row spindles 12. The opposite ends of the two slide plates 120 are fixed to rods 128, respectively, which extend through supports 130 mounted on the wall 92, and a coil spring 132 is disposed about each rod 128 to bear against the support 130 and the end of the slide plate 120 to thereby urge the slide plate 120 and the rotating brush 126 carried thereby in direction outwardly of the channel 96 and toward the spindles 12 when the spindle cleaner 20 is mounted on the spinning frame 10. It will be noted that each slide plate 120 and its associated rotating brush 126 is therefore mounted for independent movement with respect to the brush housing 74 toward and away from the spindles 12.

In addition to being mounted for independent sliding movement as described above, each of the rotating brushes 126 is independently driven from an electric drive motor 134 mounted on the top wall 136 of the brush housing 74, an electrical line 138 leading from the drive motor 134 to the junction box 116 to operate the drive motor 134. A drive shaft 140 extends from the drive motor 134 and has mounted thereon an upper driving pulley 142 for driving one of the brushes 126 and a lower driving pulley 144 for driving the other brush 126.

As best seen in FIGS. 4 and 5, the drive arrangement for one of the rotating brushes 126 includes a first pulley 146 rotatably mounted on the slide plate 120 associated with such brush, and a second pulley 148 rotatably mounted on such slide plate 12, the second pulley 148 being fixed to a driving gear 150 that meshes with a driven gear 152 rotatably carried on the shaft 124 of the brush 126. A belt 154 extends around the upper driving pulley 142 and the two pulleys 146 and 148 so that rotation of the motor drive shaft 140 causes rotation of one brush 126. Moreover, since the two pulleys 146 and 148 are mounted on slide plate 120, the previously described movement of slide plate 120 and its associated rotating brush 126 will have no adverse effect on the driving connection for such brush 126 because the tension in the belt 154 will remain unchanged at all positions of the slide 120 with respect to the fixed upper drive pulley 142.

Likewise, the other rotating brush 126 includes an independent drive arrangement which includes a double-sheaved pulley 156 and a single sheaved 158 rotatably mounted on the other slide plate 120 for movement therewith in the manner described above, and a further double-sheaved pulley 160 that is mounted on the brush housing wall 92. As described above, the pulley 158 has fixed thereto a driving gear 162 which meshes with a driven gear 164 carried on the shaft 124 of the other rotating brush 126. A first drive belt 166 extends between the lower motor pulley 144 and the upper sheave of the pulley 160, both of which are fixed with respect to one another. A second drive belt 168 extends from the lower sheave of pulley 160 to the lower sheave of pulley 156, and a conventional idler pulley 170 is arranged to bear against the second drive belt 168 to take up any slack therein and maintain a constant drive tension on the second drive belt 168. A third drive belt 172 extends between the upper sheave of pulley 156 and pulley 158, both of which are mounted on the slide plate 120 so that a constant spacing is maintained therebetween. Therefore, when the motor drive shaft 140 is operated, the other brush 126 will be independently rotated by virtue of the above-described drive arrangement. Moreover, it is to be noted that sliding movement of slide plate 120 will not affect the driving rotation of its associated brush 126 since the idler pulley 170 will maintain a proper tension in the second drive belt 168 regardless of the position of slide plate 120. Additionally, it will also be noted that the aforementioned drive arrangement for the rotating brushes 126 substantially reduces the vertical height of the drive components located directly above the brushes 126 which could interfere with the travel of the traverse ring 14 of the spinning frame 10 at the lower end of its path of movement. Thus, the only drive components which must be located directly above the rotating brushes 126 are the driven gears 152 (see FIG. 4), and these driven gears 112 can be made very thin (e.g. having a vertical thickness substantially thinner than the rotating brushes 126) so that the rotating brushes 126 can contact the lower portion of the spindles 16 while the transverse ring 14, in its normal up and down movement during building of a yarn package on the bobbins 16, will not reach or strike the thin driven gears 152. Thus, the spindle cleaner 20 of the present invention can be utilized during normal operation of the spinning frame 10 without interference with the normal operation thereof.

The upper portion 40 of the frame 26 also has mounted thereon a non-rotating brush 174 which is best illustrated in FIGS. 1, 6 and 7. The non-rotating brush 174 includes a hollow section housing 176 with the bristles of the brush 174 projecting from the open end or air intake opening thereof and with the other end thereof being connected to the aforesaid suction tubing 106 leading to the vacuum source 108. The housing 176 is fixed to a slide plate 178 slidably carried on a support plate 180 fixed to the upper frame portion 40, the slide plate 178 having a projecting horizontal surface 182 upon which the housing 176 is situated. The support plate 180 includes an upstanding flange 184 having slots 186, 188 formed therein, one slot 186 receiving therethrough a bolt 190 threaded to the slide plate 178 and the other slot 188 receiving an operating pin 192 extending from the slide plate 178 and through a cam slot 194 formed in a cam plate 196 that is pivotably mounted on the upstanding flange 184 by a pivot pin 198 and that has an operating handle 200 extending therefrom. Additionally, the slide plate 178 includes a horizontal flange 202 slidably arranged on the support plate 180 and being formed with a pair of slots 204 for receiving bolts 206 extending upwardly therethrough from the support plate 180 (see FIG. 7). Thus, when the operating handle 200 is moved to cause pivoting of the cam plate plate 196 about the pivot pin 198, the cam slot 194 will bear against the operating pin 192 to cause movement of the slide plate 178 and the non-rotating brush 174 between an extended position at which the ends of the brush bristles thereof are in linear alignment with the outermost peripheral extent of the rotatable brushes 126 and a second retracted position at which the ends of the bristles of the non-rotating brush 174 have a greater spacing from the row of spindles 12 than the outermost peripheral extent of the rotatable brushes 126.

Several advantages are obtained from the non-rotating brush 174 being adjustable. First, there are instances where the accumulation of yarn wraps at the lower portion of the spindles 12 is not particularly dense and the rotating brushes 126 are sufficient to remove such wraps. In these instances, the non-rotating brush 174 may be moved to its retracted or inactive position. Additionally, when the spindle cleaner 20 is first mounted on the spinning frame 10 at one end thereof as will be described presently, it is desirable that the rotating brushes 126 be positioned adjacent the two end spindles 12 on the spinning frame 10. However, the spindle cleaner 20 of the present invention may be used with any one of a variety of different spinning frames, and at least some of such spinning frames may include an end housing portion which is located immediately adjacent the two aforesaid end spindles to be cleaned and which projects outwardly beyond such spindles. If the non-rotating brush 174 were fixed at its extended or operating position shown in FIG. 7, no space would be provided for accommodating the projecting end portion of the spinning frame housing, and the spindle cleaner 20 would therefore have to be mounted on the spinning frame at a location spaced from the end spindles whereby such spindles would not be engaged by the rotating brushes 126 for cleaning. However, the spindle cleaner 20 of the present, invention avoids this problem since the operator can simply move the handle 200 to cause the non-rotating brush 174 to be moved to its retracted position at which sufficient space is provided to accommodate the projecting end portion of the spinning frame. Moreover, once the spindle cleaner 20 has moved along the row spindles a sufficient distance to permit the non-rotating brush 174 to clear the end of the spinning frame, the operator can move the handle 200 to cause the non-rotating brush to move to its extended position so that it will engage all of the spindles on the spinning frame during subsequent movement of the spindle cleaner 20 therealong.

The spindle cleaner 20 is adapted to be mounted for movement along the spinning frame 10 in the following manner. A pair of spaced wheels 208 are mounted on axles 210 which are carried in the upper frame portion 40, the wheels 208 being adapted to roll along the previously mentioned floor rail 22 as illustrated in FIG. 2. Additionally the upper frame portion 40 is provided with a pair of spaced guide rollers 212 arranged for rotation on vertical axes, the spacing between the guide rollers 212 being equal to the thickness of the vertical flange of the elevated rail 24 as illustrated in FIG. 2. Thus, the simultaneous engagement of the floor rail 22 by the wheels 208 and elevated rail 24 by the guide rollers 212 provides a secure mounting for the spindle cleaner 20 while permitting movement on the spindles cleaner 20 along the row of spindles 12 of the spinning frame 10.

The motive force for moving the spindle cleaner 20 along the spinning frame 10 is provided by an electric motor 214 that is secured to a slide plate 216 slidably carried on a support plate 218 fixed to the upper housing portion 40 by a plurality of guide bolts 220 extending from the slide plate 216 and through horizontally extending guide slots 222 formed in the support plate 218 as best illustrated in FIGS. 2 and 3. The front end of the slide plate 216 has mounted thereon a rotating friction wheel 224 which is arranged to engage the vertical flange of the elevated rail 24 when the slide plate 216 is disposed at its extended position as illustrated in FIG. 2. The motor 214 includes a drive shaft 226 that operates through a conventional transmission 228 to drive the rotating friction wheel 224. A cam plate 230 having a handle 232 is pivotably mounted to the support plate 218 by a pivot pin 234, and the cam plate 230 includes a caming slot 236 which receives thereon one of the guide bolts 230. To cause the spindle cleaner 20 to be positively driven along the spinning frame 10, the operator turns the handle 232 in a clockwise direction as seen in FIG. 2 whereby the slide plate 216, and the motor 214 and friction wheel 224 carried thereby, are moved to the right until the friction wheel 224 engages the vertical flange of the elevated rail 24. When it is desired to stop movement of the spindle cleaner 20, the operator moves the handle 232 in a counterclockwise direction to cause the slide plate 216 and the frictional wheel 224 to move to a retracted position spaced from the elevated rail 24. The electric motor 214 is energized through an electrical line 238 leading to the junction box 116, and an inlet power line 240 extends from the junction box 116 for connection with any convenient sources of electrical power to provide energy for the various electrical components which are connected to the junction box 116.

The spindle cleaner 20 also is provided with an electrical control switch 242 for automatically stopping further movement of the spindle cleaner 20 when it reaches the end of a row of spindles 12. This switch 242 is mounted on the upper frame portion 40 at the front end thereof during its movement along the spindles 12, and it is electrically disposed in any conventional manner in the circuit supplying electrical energy to the drive motor 214 for the friction wheel 224. The switch 242 includes a feeler rod 244 which projects outwardly therefrom in a direction generally toward the row of spindles 12 and which is fixed to a rotatable switch element 246, the feeler rod 244 having a predetermined length which assures that it will not strike or engage the spindles 12 during movement of the spindle cleaner 20 therealong, and that it will strike or engage the aforementioned projecting end portion of the spinning frame 10 at the end of the row of spindles 12. The projection rod 244 is normally at an inactive position which has no effect on the operation of the drive motor 214, but when the spindle cleaner 20 reaches the end of a row of spindles 12, the rod 244 engages the projecting end portion of the spinning frame 10 and is rotated with the switch element 246 to an active position at which it opens the electrical circuit to the drive motor 214, thereby stopping the spindle cleaner 20 at the end of a row of spindles 12 which it has cleaned.

To use the spindle cleaner 20 of the present invention, it is rolled on the floor wheels 32 to a position adjacent the floor rail 22 and the elevated rail 24 extending along a spinning frame 10, and with the two rotating brushes 126 located generally adjacent two end spindles 12 of a row. During this positioning, the upper frame portion 40 will be at its raised position with respect to the lower frame portion 28 so that the wheels 208 and the guide rolls 208 are located above the floor rail 22 and the elevated rail 24, respectively, and the non-rotating brush 174 is located at its retracted position so that it will not interfere with the projecting end portion. When the spindle cleaner 20 is properly positioned in this manner, the operator releases the holding element 64 and turns the handle 54 to cause lowering of the upper frame portion 40 with respect to the lower frame portion 28 until the guide rollers 212 engage the elevated rail 24 and the wheels 208 engage the floor rail 22, and until the floor wheels 32 are raised off the floor, all as illustrated in FIG. 2, this position of the upper frame portion 40 being maintained by engagement of the holding element 64 with the gear quadrant 62. To the extent that the rotating brushes 126 may not be in horizontal alignment with the base of the spindles 12 having yarn wraps thereon, the upstanding adjustment screws 82 are turned until the desired alignment is obtained. Likewise, if the rotating brushes 126 are not in proper contact with the spindle bases, the adjustment screws 90 are turned to obtain the desired degree of contact. All of the electrical components are then energized by a suitable "on-off" switch (not shown), and the operator then turns the handle 232 to slide the friction wheel 224 into engagement with the elevated rail 24 whereby the spindle cleaner will be moved along the row of spindles 12. After the spindle cleaner 20 has moved a sufficient distance for the non-rotating brush 174 to clean the end of the spinning frame, the operator may, if desired, turn handle 200 to cause sliding movement of the non-rotating brush toward the spindles 12 which are being rotated by the spinning frame 10, and into contact therewith.

During movement of the spindle cleaner 20 along the spinning frame 10, the two rotating brushes 126 will serially and independently engage the base of each spindle 12 to strip yarn wraps therefrom, the stripped yarn wraps being sucked in through the air inlet opening 98 and carried away. Because the spindle cleaner 20 is being positively driven by the friction wheel 224 at a relatively constant speed, and in a direction which cannot be easily reversed, it has been found that one rotating brush will frequently fail to remove all of the yarn wraps from any given spindle base, but, except in the most severe cases of yarn wrap acculation, two separate rotating brushes will provide proper yarn wrap cleaning if both brushes make proper contact with each spindle. The two rotating brushes 126 of the present invention are mounted for independent movement toward and away from the spindles, each being urged toward the spindle by its own spring 132, so that each rotating brush 126 will make maximum contact with each spindle 12 even though the spindles 12 may not be in linear alignment with one another as is frequently the case, particularly in older spinning frames. It will be noted that if the two rotating brushes 26 moved in and out as an integral unit rather than being arranged for independent movement, it is quite possible that some of the spindles would not be adequately cleaned. For example, looking at FIG. 7, it will be noted that the two rotating brushes are engaging different spindles 12. If the first of these spindles (the upper spindle in FIG. 2) was closer to the spindle cleaner 10 that the second of the spindles, and if the two rotating brushes 126 were mounted for movement as an integral unit, the rear rotating brush 126 would be held away from the rear spindle because of the engagement of the front rotating brush 126 with the front, and closer, spindle. It will be apparent that this problem is eliminated by mounting the two rotating brushes 126 for independent movement in accordance with the present invention.

It is also to be noted that even though the two rotating brushes 126 are independently movable, they are individually driven from a single drive motor 134 so that movement of one or both of the rotating brushes 126 has no adverse effect on the driving arrangement therefor. Thus, inward and outward movement of either rotating brush 126 on its associated slide plate 120 will not affect the drive of the other rotating brush 126, and, as described above, such movement will not cause any reduction in the tension of the belts 154, 166, 168 or 192 so that a driving force is always imparted to the rotating brushes 126 regardless of the position of the slide plates 120.

As the spindle cleaner 20 moves along the row of spindles 12, the non-rotating brush 174, at its extended position, will be behind the rotating brushes 126 with all three brushes in linear alignment (see FIG. 7) generally parallel to the direction of movement of the frame 26 along the row of spindles 12 whereby any residual yarn wraps or yarn wraps remaining on the base of the spindles 12 after cleaning the rotating brushes 126 will be cleaned by the non-rotating brush 174.

When the spindle cleaner 20 reaches the end of a row of spindles 12, the projecting rod 244 of the control switch 242 will strike the end of the spinning frame 10 and automatically deenergize the drive motor 214 as described above, whereupon the spindle cleaner 20 will automatically stop even if the operator is not present. Accordingly, once the spindle cleaner 20 is properly mounted on the spinning frame 10 and begins its movement therealong, the operator need not be present since the spindle cleaner 20 will automatically stop at end of its travel along the spinning frame 10.

Once the spindle cleaner 20 has completed its movement along a row of spindles 12 and stopped, the operator may then remove the spindle cleaner 20 from the spinning frame 10 by releasing the holding element 64 and operating handle 54 to raise the upper frame portion 40 with respect to the lower frame portion 28 whereby the floor wheels 32 will contact the floor, the tract wheels 208 will be disposed above the floor rail 22, and the guide rollers 212 will be disposed above the elevated rail 24. This upward movement of the upper frame portion 40 will be assisted by the force of the two springs 52 so that the operator will need to exist little or no effort in removing the spindle cleaner 20 from the spinning frame 10. Once the spindle cleaner 20 is removed from the spinning frame 10, it will be supported for rolling movement along the floor by wheels 32 so that it can be readily transported to another row of spindles.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

We claim:

1. Apparatus for removing underwound wraps of yarn from a row of rotatable spindles on a textile yarn spinning machine comprising:

(a) carrier means arranged for movement along said row of spindles, (b) a plurality of rotatable yarn stripping members disposed for engagement with said spindle to remove said underwound wraps of yarn therefrom, (c) separate mounting means for each of said yarn stripping members, each of said mounting means being arranged for independent movement with respect to said carrier means toward and away from said row of spindles in a direction generally perpendicular to the direction of movement of said carrier means along said row of spindles;

(d) biasing means for urging each said mounting means in said direction toward said spindle; and (e) driving means for positively rotating said plurality of yarn stripping members, 2. Apparatus for removing underwound wraps of yarn according to claim 1 and characterized further in that each said yarn stripping member is a disc shaped rotatable brush, each said rotatable brush having an axis of rotation generally perpendicular to the direction of said movement of said carrier means along said row of spindles.

3. Apparatus for removing underwound wraps of yarn according to claim 2 and characterized further in that each said separate mounting means includes a plate rigidly attached to one of said rotatable brushes and slidably mounted on said carrier means for movement with respect thereto, each said plate being independently urged by said biasing means whereby each said plate and its respective rotatable brush are biased as a unit and move as a unit.

4. Apparatus for removing underwound wraps of yarn according to claim 2 and characterized further in that said plurality of rotatable brushes are normally arranged on said mounting means in linear alignment generally parallel to said direction of movement of said carrier means along said row of spindles.

5. Apparatus for removing underwound wraps of yarn as defined in claim 4 and further characterized in that a non-rotatable brush is disposed on said carrier means adjacent to and behind said rotatable brushes in relation to said movement thereof along said row of spindles, said non-rotatable brush having bristles extending in a direction toward said row of spindles, and said non-rotatable brush being mounted on means for selectively moving said non-rotatable brush between a first position at which the ends of said bristles thereof are in linear alignment with the outermost peripheral extent of said rotatable brushes and a second position at which said ends of said bristles have a greater spacing from said row of spindles than said outermost peripheral extent of said rotatable brushes.

6. Apparatus for removing underwound wraps of yarn according to claim 1 and characterized further in that said brush driving means includes a separate drive component drivingly connected to each said rotatable brush whereby each said rotatable brush is driven independently of the remainder of said rotatable brushes 7. Apparatus for removing underwound wraps of yarn according to claim 6 and characterized further in that said rotatable brush driving means includes:

(a) A motor;

(b) a drive shaft driven by said motor and having a plurality of driving pulleys mounted thereon;

(c) a plurality of driven pulleys each having a driving connection to one said driving pulleys and each having a driving gear rigidly mounted thereto for rotation therewith;

(d) a plurality of thin disc shaped driven gears each being rigidly connected to one of said rotatable brushes for rotation therewith, each said driven gear being engaged at the periphery thereof by one of said driving gears.

8. Apparatus for removing underwound wraps of yarn according to claim 7 and further characterized in that each said driven gear is disposed above its associated rotatable brush and has a vertical thickness substantially thinner than the vertical thickness of said associated rotatable brush.

9. Apparatus for removing underwound wraps of yarn according to claim 1 and further including second driving means associated with said carrier means for removing said carrier means along said row of spindles.

10. Apparatus for removing underwound wraps of yarn according to claim 9 and further characterized in that a fixed rail is provided to extend along said yarn spinning machine and said row of spindles thereof, and in that said second driving means includes a rotating driving wheel disposed for frictional engagement with said rail to cause said movement of said carrier means.

11. Apparatus for removing underwound wraps of yarn according to claim 10 and characterized further in that said second driving means includes control means for permitting selective movement of said drive wheel thereof between a first position at which said drive wheel frictionally engages said rail and a second position at which said drive wheel is spaced therefrom.

12. Apparatus for removing underwound wraps of yarn according to claim 10 and characterized further in that a support rail is attached to the floor adjacent to and extending along said spinning machine, and in that said carrier means includes a supporting frame, said supporting frame including engagement means for simultaneously engaging said spindle rail and said floor rail during movement of said yarn removal apparatus along said row of spindles.

13. Apparatus for removing underwound wraps of yarn according to claim 12 and characterized further in that said floor support rail and said fixed rail each include an upstanding wall, and in that said supporting frame includes a plurality of guide rollers disposed in spaced relation to form a guide slot therebetween for receiving said upstanding wall of said fixed rail in rolling contact with said guide rollers, and includes wheels disposed to engage the upstanding wall of said floor support rail.

14. Apparatus for removing underwound wraps of yarn according to claim 12 and further characterized in that said supporting frame includes a first frame portion supporting said mounting means for said yarn stripping members, said first frame portion having supporting wheels for engagement with said floor support rail, a second frame portion having attached thereto a plurality of floor engaging wheels, cooperating means for permitting selective vertical movement of said first frame portion between an extended and a retracted position with respect to said second frame portion.

15. Apparatus for removing underwound wraps of yarn according to claim 14 and further characterized in that said cooperating means includes a first tubular element fixed to said first frame portion, a second tubular element fixed to said second frame portion and slidably received by said first tubular element, spring means disposed within said first and second tubular elements to urge said first frame portion toward said extended position thereof with respect to said second frame portion, and operating means for moving said first frame portion against said spring means to said retracted position thereof with respect to said second frame portion.

16. Apparatus according to claim 12 and further characterized in that said supporting frame includes adjustment means for selectively adjusting the vertical position of said mounting means with respect to said supporting frame to facilitate the alignment of said yarn stripping members with respect to said underwound wraps of yarn.

17. Apparatus for removing underwound wraps of yarn according to claim 10 and further characterized in that said carrier drive means includes an electric motor, and in that a control switch is mounted on said carrier means for selectively deenergizing said electric motor, said control switch including a protruding operating rod movable between an inactive position and an active position at which said control switch deenergizes said electric motor, said protruding operating rod being arranged to engage an end portion of said spinning machine and be moved thereby to said active position.

* * * * *

UNITED STATES PATENT OFFICE

CERTIFICATE OF CORRECTION

Patent No. 4,133,168 Dated January 9, 1979

Inventor(s) Alex J. Keller, Jr. and Eddie R. Best

It is certified that error appears in the above-identified patent and that said Letters Patent are hereby corrected as shown below:

Col. 1, line 28, after "For," delete "wraps" and insert therefor --example--. Col. 1, line 39, delete "warps" and insert therefor --wraps--. Col. 6, line 24, delete "drive" and insert therefor --driving--. Col. 12, line 10, after "one" insert --of--. Col. 12, line 27, delete "removing" and insert therefor --moving--.

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*